US009401573B1

(12) United States Patent
Fernandez et al.

(10) Patent No.: US 9,401,573 B1
(45) Date of Patent: Jul. 26, 2016

(54) ELECTRICAL PLUG CONNECTOR

(71) Applicants: Xentris Wireless LLC, Addison, IL (US); Advanced-Connectek Inc., New Taipei (TW)

(72) Inventors: Fernandel M. Fernandez, Lindenhurst, IL (US); Min-Lung Chien, New Taipei (TW); Ming-Yung Chang, New Taipei (TW)

(73) Assignees: XENTRIS WIRELESS LLC, Addison, IL (US); ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/982,162

(22) Filed: Dec. 29, 2015

(51) Int. Cl.
*H01R 24/60* (2011.01)
*H01R 107/00* (2006.01)
*H01R 13/6593* (2011.01)

(52) U.S. Cl.
CPC ..... *H01R 24/60* (2013.01); *H01R 13/6593* (2013.01); *H01R 2107/00* (2013.01)

(58) Field of Classification Search
CPC .. H01R 24/60; H01R 2107/00; H01R 9/2425; H01R 13/652; H01R 13/6581; H01R 13/6583; H01R 13/6592; H01R 13/6593
USPC ..... 439/620.21, 108, 607.17, 607.27, 439/607.41, 607.46, 607.55, 660
See application file for complete search history.

(56) References Cited

U.S. PATENT DOCUMENTS

| | | | | | |
|---|---|---|---|---|---|
| 5,725,395 | A * | 3/1998 | Lee | H01R 13/504 | 439/108 |
| 5,797,771 | A * | 8/1998 | Garside | H01R 13/6275 | 439/358 |
| 6,336,827 | B1 * | 1/2002 | Akama | H01R 12/62 | 174/261 |
| 7,955,132 | B2 * | 6/2011 | Luo | H01R 12/62 | 439/607.41 |
| 8,708,753 | B2 * | 4/2014 | Wang | H01R 13/6658 | 439/660 |
| 9,318,858 | B2 * | 4/2016 | Saito | H01R 27/00 | |
| 2007/0287330 | A1 * | 12/2007 | Chien | H01R 24/58 | 439/607.01 |
| 2015/0222064 | A1 * | 8/2015 | Saito | H01R 27/00 | 439/218 |

* cited by examiner

*Primary Examiner* — Neil Abrams
*Assistant Examiner* — Travis Chambers
(74) *Attorney, Agent, or Firm* — Babcock IP, PLLC

(57) ABSTRACT

An electrical plug connector includes an insulated housing, conductive terminals, and a metallic shell. The insulated housing includes a base portion and recessed portions configured at two sides of the base portion. The conductive terminals are held at the base portion. The metallic shell includes a body shell, two stopping pieces, two holding portions, and an extending sheet. The body shell encloses the base portion and defines two engaging grooves. The stopping pieces are protruded out of lateral inner surfaces of the body shell to engage with the recessed portions. The holding portions allow connections of portions of the body shell spaced by the engaging groove and hold two sides of the circuit board from moving. Engaging pieces of the extending sheet are engaged with the circuit board to prevent the circuit board from being detached from the insulated housing to prevent charging or data transmission failure.

12 Claims, 7 Drawing Sheets

ELECTRICAL PLUG CONNECTOR

FIELD OF THE INVENTION

The instant disclosure relates to an electrical connector, and more particular to an electrical plug connector.

BACKGROUND

Generally, Universal Serial Bus (USB) is a serial bus standard to the Personal Computer (PC) architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. These devices require significantly more bus bandwidth to maintain the interactive experience that users have come to expect. In addition, the demand of a higher performance between the PC and increasingly sophisticated peripherals is increasing. The transmission rate of USB 2.0 is insufficient. As a consequence, faster serial bus interfaces such as USB 3.0, have been developed, which may provide a higher transmission rate so as to satisfy the need of a variety devices.

Electronic devices, such as personal mobile devices, tablet computers, etc., have become lighter, thinner, shorter, and smaller. In order to reduce the size of the electronic device, the electrical receptacle connector assembled to the electronic device needs to be small and precise. Normally, the electronic device has a standardized connector interface such as a Micro USB electrical receptacle connector adapted to be mated with a Micro USB electrical plug connector for power or signal transmission.

A conventional Micro USB electrical plug connector comprises a plastic core, a plurality of terminals, an upper shell, and a lower shell. The plastic core has a base portion and a tongue portion extended from the base portion. The terminals are held in the base portion, one end of each of the terminals is located at the surface of the tongue portion, and the other end of each of the terminals is protruded from the base portion and soldered with a circuit board. The upper shell and the lower shell are combined with each other to enclose the base portion and the circuit board. However, the upper shell and the lower shell provide functionality for covering the circuit board, but not positioning the circuit board. In addition, the lower shell defines grooves at two sides for assembling the circuit board. When the circuit board is assembled into the grooves, the lower shell may be deformed or bent easily because the lower shell is devoid of strengthening structures.

SUMMARY OF THE INVENTION

Consequently, how to improve the existing electrical plug connector becomes an issue.

In view of this, the instant disclosure provides an electrical plug connector. An exemplary embodiment of the electrical plug connector includes an insulated housing, a plurality of conductive terminals, and a metallic shell. The insulated housing includes a base portion, a tongue portion, and a plurality of recessed portions. The tongue portion is extended forward from the base portion in a rear-to-front direction. An inserting groove may be defined at the surface of the tongue portion. The recessed portions may be respectively configured at two sides of the base portion. The conductive terminals are respectively held at the base portion and the tongue portion. One of two ends of each of the conductive terminals is located in the inserting groove, and the other end of each of the conductive terminals may be extended out of the base portion. The metallic shell at least partially encloses the insulated housing. The metallic shell may include a body shell, two stopping pieces, two holding portions, and an extending sheet. The body shell at least partially encloses the base portion. Two engaging grooves are respectively defined through two sides of the body shell. The stopping pieces are respectively protruded out of two lateral inner surfaces of the body shell to engage with the recessed portions. The holding portions are respectively configured at the two sides of the body shell and near to the engaging grooves. Each of the holding portions may include a bent sheet and an inward depressed portion. The bent sheet may be connected between a portion of the body shell near to one of two opposite inner walls of the engaging groove and a portion of the body shell near to the other inner wall of the engaging groove. The inward depressed portion may be formed as an inner surface of the bent sheet. The extending sheet may be extended outward from the rear of the body shell. A plurality of engaging pieces may be extended from two sides of the extending sheet and bent toward each other.

In some embodiments, the electrical plug connector further includes a circuit board. One of two ends of the circuit board may be inserted into the body shell, and a top surface and a bottom surface of two sides of the circuit board respectively abutted against the inner walls of the engaging grooves. In addition, two sides of the circuit board may be respectively protruded from the two engaging grooves and held by the two inward depressed portions. Furthermore, the distance between inner walls of the inward depressed portions may be greater than the distance between the outer surfaces of the body shell.

In some embodiments, the engaging pieces may be respectively engaged with the two sides of the other end of the circuit board and abutted against the top surface of the circuit board. In addition, the extending sheet may include a plurality of sidewalls respectively abutted against the bottom surface of the circuit board.

In some embodiments, the metallic shell includes an enclosing shell. The enclosing shell comprises a body portion and two positioning plates extended outward from the body portion. The body portion encloses the tongue portion, and the positioning plates are engaged with the base portion. In addition, the circuit board may include a plurality of terminal contacts and a ground contact. The other ends of the conductive terminals may be configured for connection to the terminal contacts. The enclosing shell may include a ground leg extended from one of the positioning plates and connected to the ground contact.

In some embodiments, the metallic shell includes a protruded portion defined at the outer surface of the extending sheet.

In some embodiments, the metallic shell includes a wire clamping member and a plurality of strengthening portions. The wire clamping member may be extended outward from the extending sheet, and the strengthening portions may be formed between the wire clamping member and the extending sheet.

Based on the above, because the stopping pieces are protruded out of the lateral inner surfaces of the body shell to engage with the recessed portions, when the base portion is assembled in the body shell, the stopping pieces provide a stopping function and respectively engage with the recessed portions, so that the base portion can be prevented from being detached from the body shell. In addition, the bent sheet allows the connection of two portions of the body shell spaced by the engaging groove, so that when the circuit board is assembled to the body shell, the body shell may be prevented from being deformed by the push of the circuit board. Moreover, since the bent sheets hold the two sides of the circuit board, it prevents the circuit board from being detached from the insulated housing after being shaken vertically or horizontally and thus prevents charging or data transmission failure. Furthermore, the engaging pieces are respectively engaged with the two sides of the other end of the circuit board and abutted against the top surface of the circuit board, so that the inserting end of the circuit board is positioned by the holding portions, and the soldering end of the circuit board is positioned by the engaging pieces, and the engaging pieces are abutted against the top surface of the circuit board to prevent the circuit board from being deflected upward and detached from the insulated housing.

Detailed description of the characteristics and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
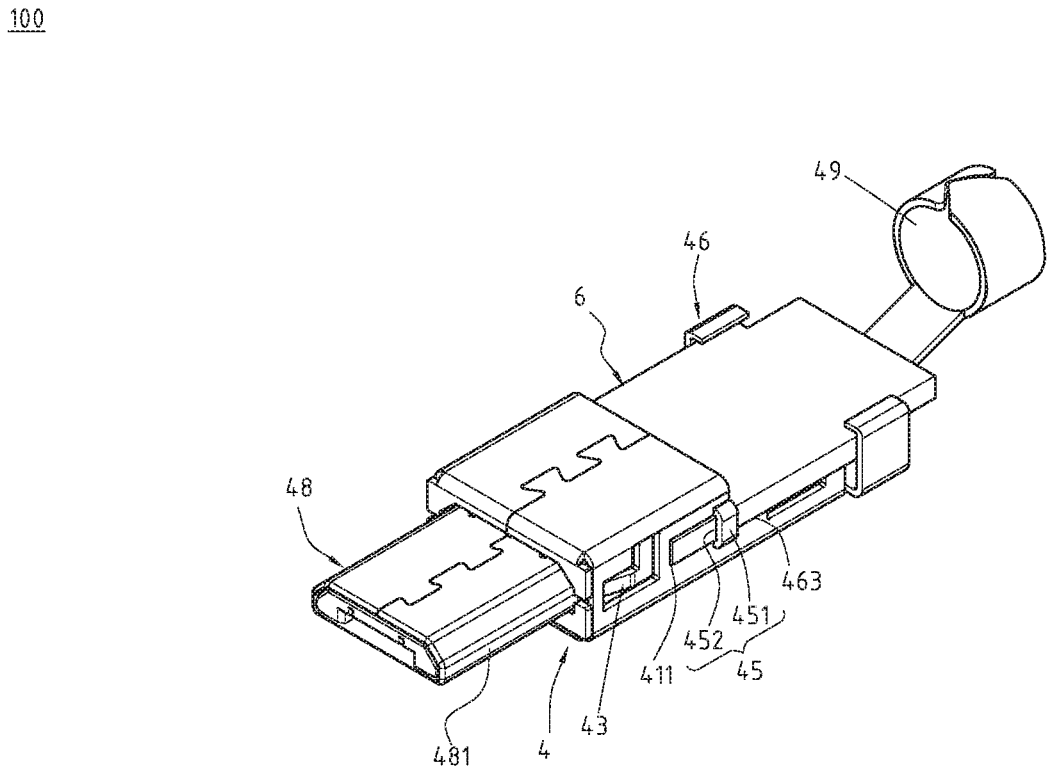
FIG. 1 illustrates a perspective view of an electrical plug connector according to an exemplary embodiment of the instant disclosure.

Please refer to FIG. 1, which illustrates an electrical plug connector 100 of an exemplary embodiment according to the instant disclosure. FIG. 1 illustrates a perspective view of the electrical plug connector 100. The electrical plug connector 100 is here demonstrated as a connector including a interconnection interface for a Micro USB connector and is a USB 2.0 connector, but embodiments are not limited thereto. In some embodiments, the electrical plug connector 100 may be provided, for example, as a USB type-C connector. The electrical plug connector 100 comprises an insulated housing 1, a plurality of conductive terminals 2, and a metallic shell 4.

Figure 2:
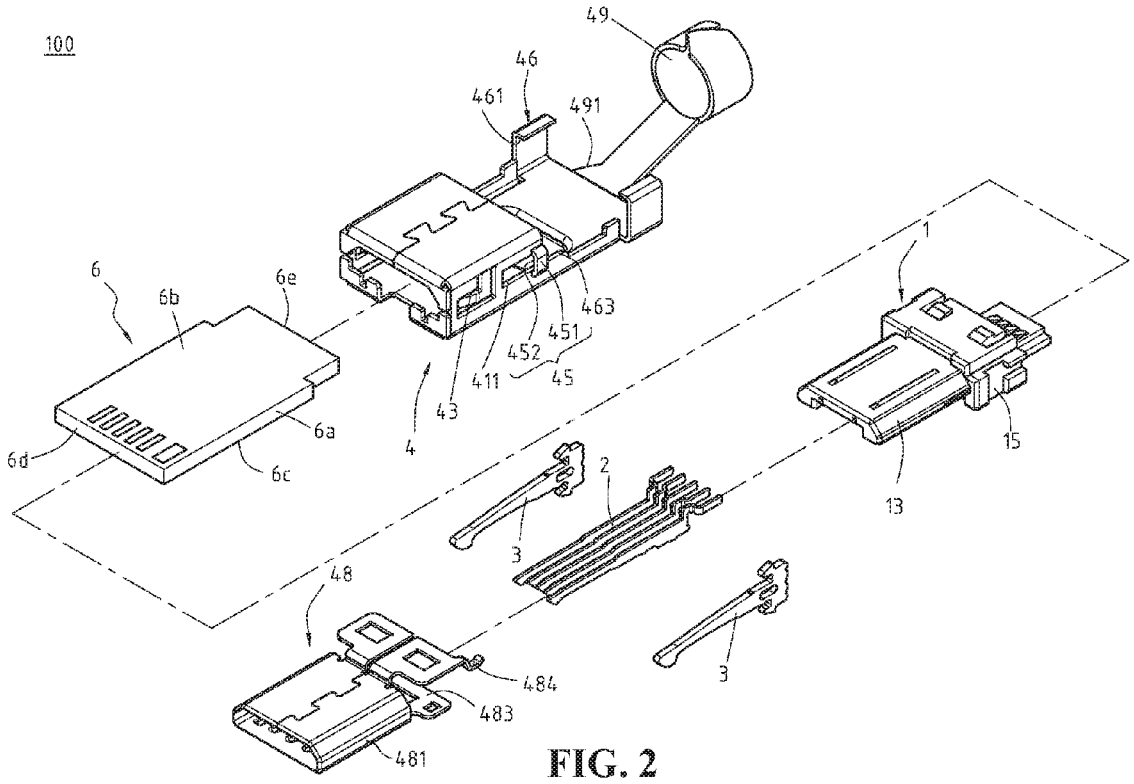
FIG. 2 illustrates an exploded view (1) of the electrical plug connector.
Figure 3:
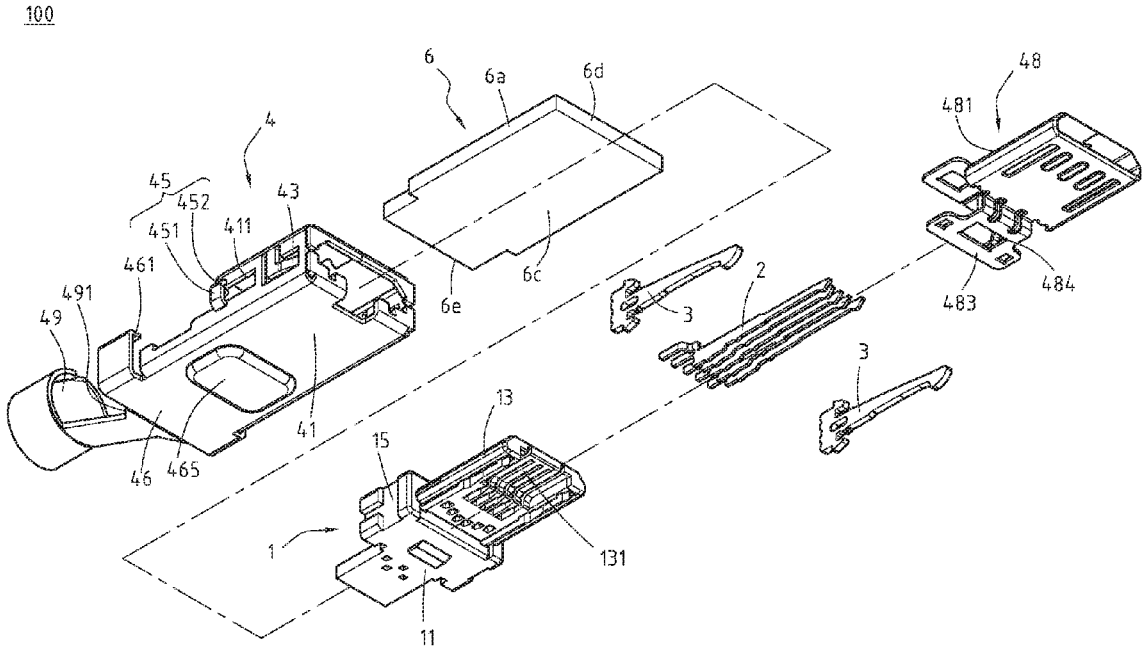
FIG. 3 illustrates an exploded view (2) of the electrical plug connector.

Please refer to FIGS. 2 to 3, which respectively illustrate top and bottom exploded views of the electrical plug connector 100. In this embodiment, the insulated housing 1 comprises a base portion 11, a tongue portion 13, and a plurality of recessed portions 15. In this embodiment, the base portion 11 and the tongue portion 13 may be fabricated via injection molding or the like. The tongue portion 13 may extend forward from the base portion 11 in a rear-to-front direction, according to the desired interconnection interface. The tongue portion 13 has an upper surface and a lower surface opposite to the upper surface. The tongue portion 13 may further comprises an inserting groove 131. The inserting groove 131 is defined at the front portion of the top surface of the tongue portion 13. The recessed portions 15 are respectively defined at two sides of the base portion 11.

Please refer to FIGS. 2 to 3. In this embodiment, the number of the conductive terminals 2 is five and the configuration of the conductive terminals 2 meets the Micro USB standard specification. The conductive terminals 2 may be respectively held at the base portion 11 and/or the tongue portion 13. One of two ends of each of the conductive terminals 2 may be located in the inserting groove 131, and the other end of each of the conductive terminals 2 may be extended out of the base portion 11. In this embodiment, each of the conductive terminals 2 comprises a blanking-type flexible contact portion, a connecting portion, and an Surface Mount Technology (SMT) tail portion. The body portion 481 may be retained upon the insulated housing 1. The blanking-type flexible contact portion is extended forward from the connecting portion in the rear-to-front direction to partly project toward the inserting groove 131. The SMT tail portion may be extended backward from the connecting portion in the front-to-rear direction and protruded from the base portion 11. The conductive terminals 2 form a row of SMT tail portions whose structures are simple, enabling a consistent quality in soldering procedures. In addition, the insulated housing 1 and the conductive terminals 2 may be assembled with each other by means of crimping, and the connecting portions are positioned at the insulated housing 1. When the SMT tail portions of the conductive terminals 2 are soldered with a circuit board 6, the space of the circuit board 6 for the layout of the conductive terminals 2 can be efficiently reduced.

In alternative embodiments, the conductive terminals 2 may be provided, for example, as a bundle positioned with respect to one another by a spacer or the like, the bundle seating within the insulated housing 1.

Please refer to FIGS. 2 to 3. In this embodiment, the electrical plug connector 100 further comprises a plurality of buckling members 3. The buckling members 3 are positioned in the insulated housing 1 and respectively located at two sides of the conductive terminals 2. Moreover, a hook portion is formed at the front of each of the buckling members 3. The hook portion is protruded from an enclosing shell 48 of the metallic shell 4 and adapted to buckle with an electrical receptacle connector, so that the electrical plug connector 100 can be firmly mated with the corresponding electrical receptacle connector.

Please refer to FIGS. 2 to 3. In this embodiment, the metallic shell 4 is a hollowed shell. The metallic shell 4 may be formed, for example, by metallic injection molding. The metallic shell 4 at least partially encloses the insulated housing 1. In this embodiment, the metallic shell 4 comprises a body shell 41 and an enclosing shell 48. The body shell 41 and the enclosing shell 48 are demonstrated as separated members but may be assembled with each other. The enclosing shell 48 comprises a body portion 481 and two positioning plates 483 extended outward from the body portion 481. The body portion 481 partially encloses the tongue portion 13, and the positioning plates 483 are engaged with the base portion 11. In other words, the base portion 11 has buckling blocks, and each of the positioning plates 483 defines a buckling hole.

Thus, the buckling blocks may be assembled with the buckling holes so that the enclosing shell 48 firmly encloses the insulated housing 1.

Please refer to FIGS. 2 to 3. In this embodiment, the metallic shell 4 comprises the body shell 41, two stopping pieces 43, two holding portions 45, and an extending sheet 46. The body shell 41 is demonstrated as a generally rectangular hollowed shell. The body shell 41 is dimensioned to at least partially enclose the base portion 11. When the insulated housing 1 is assembled with the body shell 41, the base portion 11 may be positioned in the body shell 41 with the tongue portion 13 protruding from the body shell 13.

Please refer to FIGS. 2 to 3. In this embodiment, the body shell 41 comprises two engaging grooves 411 respectively defined through two sides of the body shell 41. In other words, the engaging grooves 411 are grooves formed at the two sides of the body shell 41 for receiving two sides 6*a* of the circuit board 6. In this embodiment, an inserting end 6*d* of the circuit board 6 is inserted into the body shell 41, and the top surface 6*b* and the bottom surface 6*c* of the two sides 6*a* of the circuit board 6 are respectively abutted against the inner walls of the engaging grooves 411.

Please refer to FIGS. 2 to 3. In this embodiment, the stopping piece 43 is demonstrated as L-shaped. The two stopping pieces 43 are respectively protruded out of the two lateral inner surfaces of the body shell 41. When the base portion 11 is assembled in the body shell 41, the stopping pieces 43 provide a stopping function and respectively engage with the recessed portions 15, so that the base portion 11 can be securely retained by the body shell 41.

Please refer to FIGS. 2 to 3. In this embodiment, the two holding portions 45 are respectively configured at the two sides of the body shell 41 and near to the engaging grooves 411. Each of the holding portions 45 comprises a bent sheet 451 and an inward depressed portion 452. The cross section of the bent sheet 451 is approximately C-shaped. Each of the bent sheets 451 is extended between a portion of the body shell 41 near to one of two opposite inner walls of the corresponding engaging groove 411 and a portion of the body shell 41 near to the other inner wall of the same engaging groove 411. The bent sheet 451 allows the connection of two portions of the body shell 41 spaced by the engaging groove 411, so that when the circuit board 6 is assembled to the body shell 41, the body shell 41 is prevented from being deformed by the push of the circuit board 6.

Figure 6:
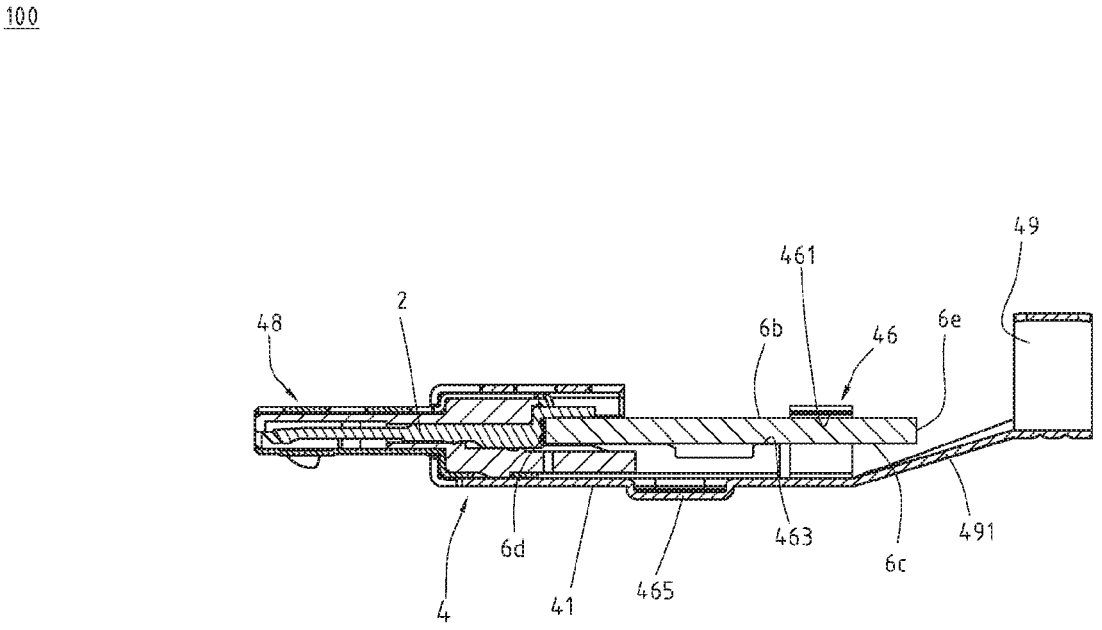
FIG. 6 illustrates a side sectional view of the electrical plug connector.
Figure 7:
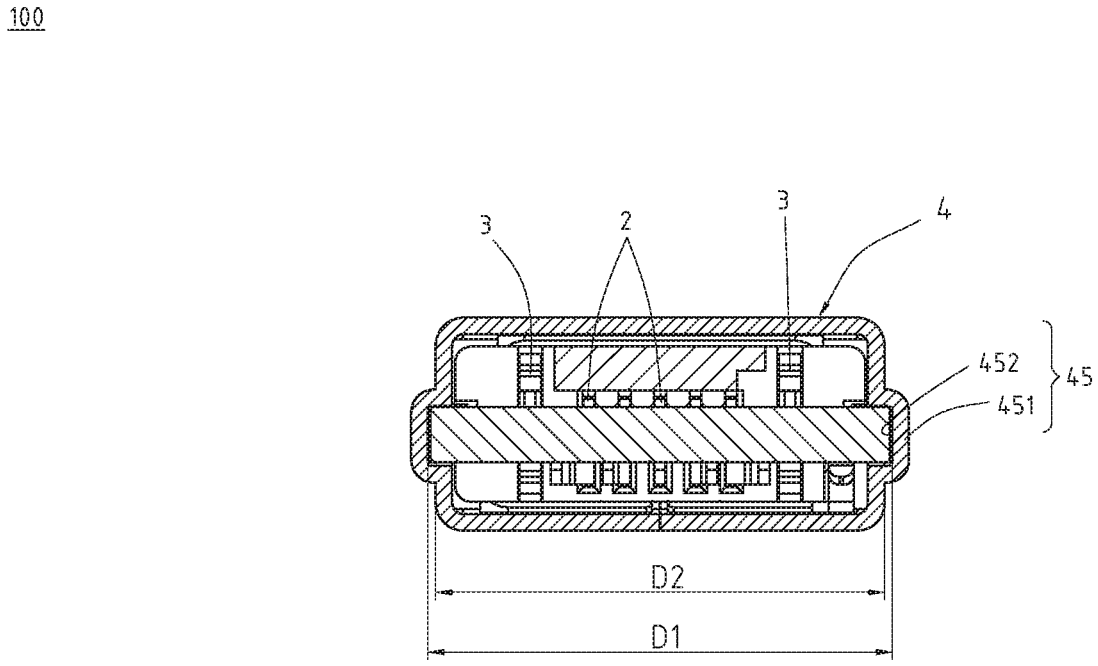
FIG. 7 illustrates a front sectional view of the electrical plug connector.

Please refer to FIGS. 2 to 3 and FIGS. 6 to 7. FIG. 6 illustrates a side sectional view of the electrical plug connector 100. FIG. 7 illustrates a front sectional view of the electrical plug connector 100. In this embodiment, the inward depressed portions 452 are respectively formed as the inner surfaces of the bent sheets 451. When the circuit board 6 is assembled to the rear of the base portion 11, the two sides 6*a* of the circuit board 6 are respectively protruded from the two engaging grooves 411 and held by the two inward depressed portions 452. In addition, the distance D1 between the inner walls of the inward depressed portions 452 is greater than the distance D2 between the outer surfaces of the body shell 41. The distance D1 between the inner walls of the inward depressed portions 452 is mated with the width between the two sides 6*a* of the circuit board 6. Therefore, since the bent sheets 451 hold the two sides 6*a* of the circuit board 6, it prevents the circuit board 6 from being detached from the insulated housing 1 after being shaken vertically or horizontally and thus prevents charging or data transmission failure.

Please refer to FIGS. 2 to 3 and FIGS. 6 to 7. In this embodiment, the extending sheet 46 is an elongated sheet. The extending sheet 46 is extended outward from the rear of the body shell 41. A plurality of engaging pieces 461 is extended from two sides of the extending sheet 46 and bent toward each other. The engaging pieces 461 are respectively engaged with the two sides of the other end of the circuit board 6 and abutted against the top surface 6*b* of the circuit board 6. In other words, one of two ends of the circuit board 6, i.e., the inserting end 6*d* of the circuit board 6, is positioned by the two holding portions 45, while the other end of the circuit board 6, i.e., the soldering end 6*e* of the circuit board 6 is positioned by the engaging pieces 461. The engaging pieces 461 are abutted against the top surface 6*b* of the circuit board 6 to prevent the circuit board 6 from being deflected upward detached from the insulated housing 1. In addition, the engaging pieces 461 further hold the two sides 6*a* of the circuit board 6 to prevent the lateral movement of the circuit board 6. In this embodiment, the extending sheet 46 further comprises a plurality of sidewalls 463 respectively abutted against the bottom surface 6*c* of the circuit board 6, so that the circuit board 6 can be firmly positioned in the insulated housing 1.

Please refer to FIGS. 2 to 3 and FIGS. 6 to 7. In this embodiment, the circuit board 6 comprises a plurality of terminal contacts 61, a ground contact 63, and a solder wire contact, and the circuit board 6 may further comprises electronic components such as LEDs, processing/control chips, etc. The other ends of the conductive terminals 2 are connected to the terminal contacts 61. The enclosing shell 48 comprises a ground leg 484 extended from one of the two positioning plates 483 and connected to a circuit board ground, here demonstrated as ground contact 63.

Figure 4:
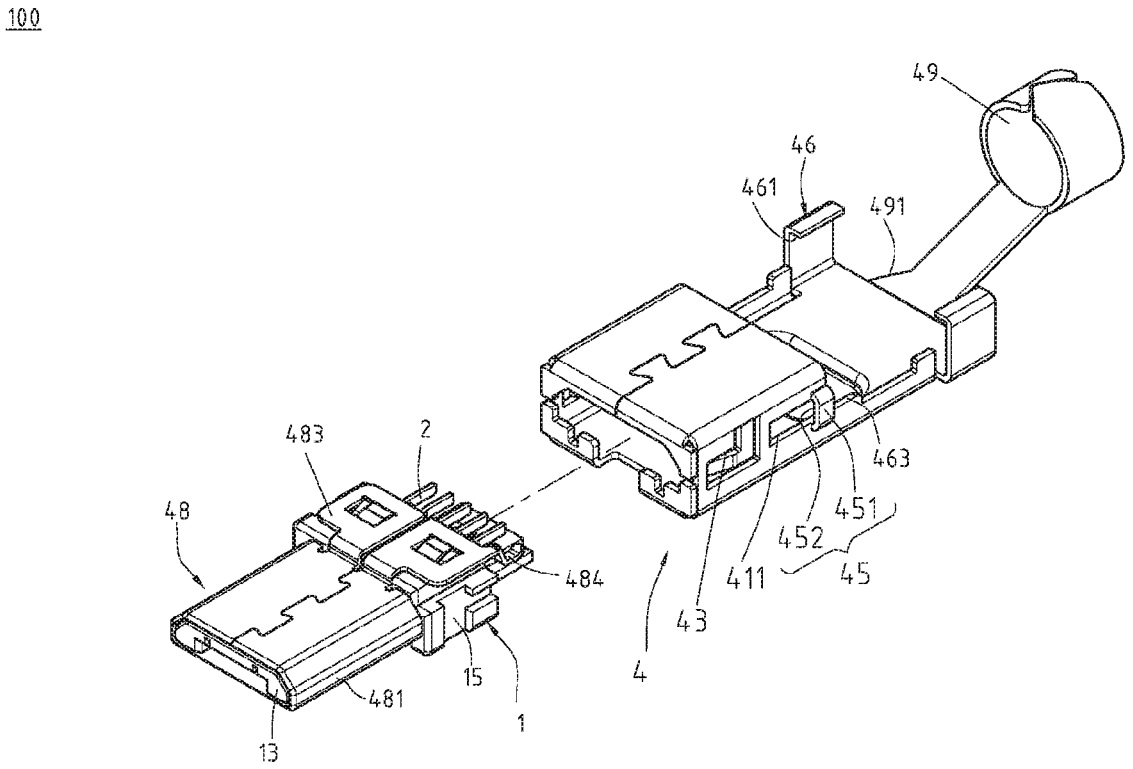
FIG. 4 illustrates an exploded view (3) of the electrical plug connector, circuit board omitted.
Figure 5:
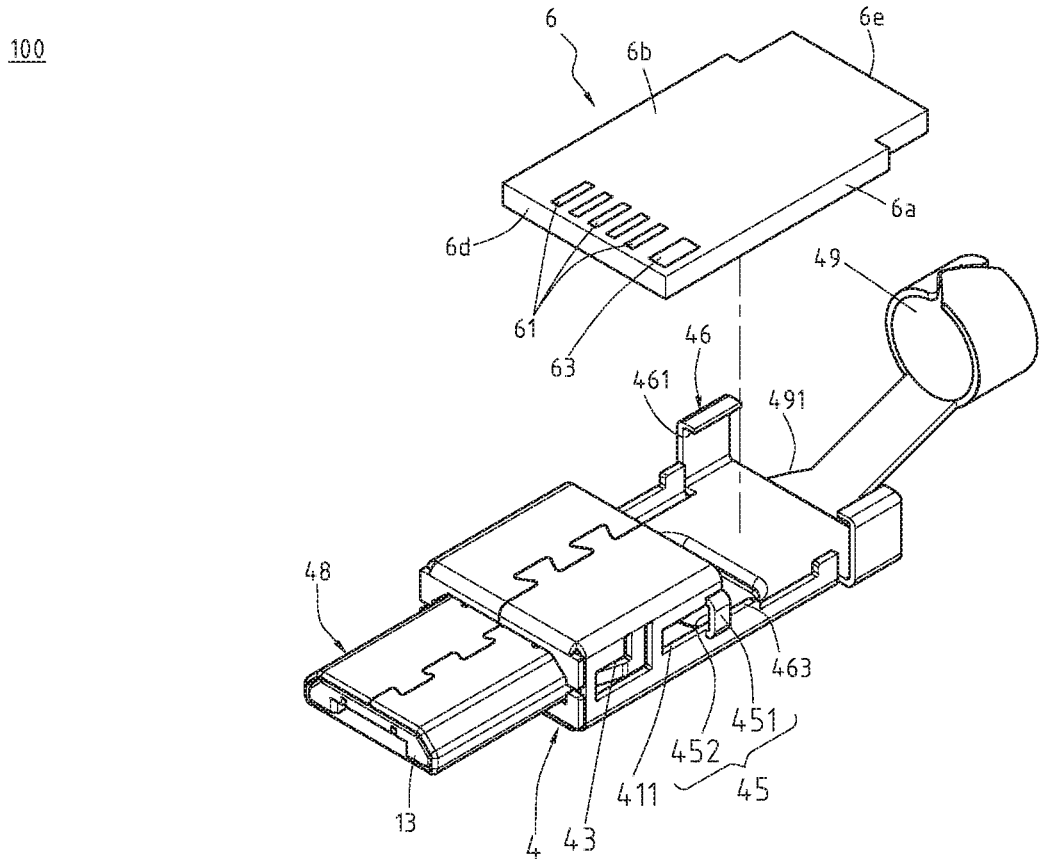
FIG. 5 illustrates an exploded view (4) of the electrical plug connector.

Please refer to FIGS. 2 to 5. FIGS. 4 and 5 illustrate exploded views of the electrical plug connector 100. In this embodiment, the assembling of the electrical plug connector 100 is described as following. Firstly, the enclosing shell 48 is assembled with the insulated housing 1, and the circuit board 6 is soldered at the rear of the insulated housing 1 and connected to the conductive terminals 2. And then, the assembly of the enclosing shell 48, the insulated housing 1, and the circuit board 6 is inserted into the body shell 41 in a rear-to-front direction and parts of the assembly is protruded from the body shell 41, as shown in FIG. 1. Hence, the two stopping pieces 43 of the body shell 41 are respectively engaged with the recessed portions 15, the two sides 6*a* of the circuit board 6 are received in the respective engaging grooves 411 and the respective bent sheets 451, and the engaging pieces 461 are respectively engaged with the two sides of the other end of the circuit board 6.

Please refer to FIG. 3 and FIG. 6. In this embodiment, the metallic shell 4 further demonstrates application of a protruded portion 465 defined at the outer surface of the extending sheet 46 for improving the structural strength of the extending sheet 46.

Please refer to FIG. 4 and FIG. 6. In this embodiment, the metallic shell 4 further demonstrates a wire clamping member 49 and a plurality of strengthening portions 491. The wire clamping member 49 is extended outward from the extending sheet 46. The wire clamping member 49 is adapted to position and fasten a wire or cable. In addition, the strengthening portions 491 are formed between the wire clamping member 49 and the extending sheet 46. The strengthening portions 491 are located at two sides of the wire clamping member 49 to increase the area of the connection between the wire clamping member 49 and the extending sheet 46. Therefore, the structural strength of the connection between the wire clamping member 49 and the extending sheet 46 can be improved. Accordingly, when the electrical plug connector 100 is detached from the electrical receptacle connector, the wire of the electrical plug connector 100 is pulled, and the pulling force would be delivered to the connection between the wire clamping member 49 and the extending sheet 46. Since the structural strength of the connection between the wire clamping member 49 and the extending sheet 46 is improved by the strengthening portions 491, the connection may have improved resistance to breakage upon being forced.

Based on the above, since the stopping pieces are protruded out of the lateral inner surfaces of the body shell to engage with the recessed portions, when the base portion is assembled in the body shell, the stopping pieces provide a stopping function and respectively engage with the recessed portions, so that the base portion can be prevented from being detached from the body shell. In addition, the bent sheet allows the connection of two portions of the body shell spaced by the engaging groove, so that when the circuit board is assembled to the body shell, the body shell is prevented from being deformed by the push of the circuit board. Moreover, since the bent sheets hold the two sides of the circuit board, it prevents the circuit board from being detached from the insulated housing after being shaken vertically or horizontally and thus prevents charging or data transmission failure. Furthermore, the engaging pieces are respectively engaged with the two sides of the other end of the circuit board and abutted against the top surface of the circuit board, so that the inserting end of the circuit board is positioned by the holding portions, and the soldering end of the circuit board is positioned by the engaging pieces, and the engaging pieces are abutted against the top surface of the circuit board to prevent the circuit board from being deflected upward and detached from the insulated housing.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

an insulated housing comprising a base portion, a tongue portion, and a plurality of recessed portions, wherein the tongue portion is extended forward from the base portion in a rear-to-front direction, an inserting groove is defined at the surface of the tongue portion, the recessed portions are respectively configured at two sides of the base portion;

a plurality of conductive terminals respectively held at the base portion and the tongue portion, one of two ends of each of the conductive terminals located in the inserting groove, and the other end of each of the conductive terminals extended out of the base portion; and a metallic shell partially enclosing the insulated housing, wherein the metallic shell comprises:

a body shell partially enclosing the base portion, wherein two engaging grooves are respectively defined through two sides of the body shell;

two stopping pieces respectively protruded out of two lateral inner surfaces of the body shell to engage with the recessed portions;

two holding portions respectively configured at the two sides of the body shell and near to the engaging grooves, each of the holding portions comprises a bent sheet and an inward depressed portion, the bent sheet is connected between a portion of the body shell near to one of two opposite inner walls of the engaging groove and a portion of the body shell near to the other inner wall of the engaging groove, and the inward depressed portion is formed as an inner surface of the bent sheet; and an extending sheet extended outward from a rear of the body shell, wherein a plurality of engaging pieces extend from two sides of the extending sheet and are bent toward each other.

2. The electrical plug connector according to claim 1, wherein the metallic shell further comprises a protruded portion defined at the outer surface of the extending sheet.

3. The electrical plug connector according to claim 1, wherein the metallic shell comprises a wire clamping member and a plurality of strengthening portions, the wire clamping member is extended outward from the extending sheet, and the strengthening portions are formed between the wire clamping member and the extending sheet.

4. The electrical plug connector according to claim 1, further comprising a circuit board, wherein one of two ends of the circuit board is inserted into the body shell, and a top surface and a bottom surface of two sides of the circuit board are respectively abutted against the inner walls of the engaging grooves.

5. The electrical plug connector according to claim 4, wherein the two sides of the circuit board are respectively protruded from the two engaging grooves and held by the two inward depressed portions.

6. The electrical plug connector according to claim 5, wherein the distance between the inner walls of the inward depressed portions is greater than the distance between the outer surfaces of the body shell.

7. The electrical plug connector according to claim 4, wherein the engaging pieces are respectively engaged with the two sides of the other end of the circuit board and abutted against the top surface of the circuit board.

8. The electrical plug connector according to claim 7, wherein the extending sheet comprises a plurality of sidewalls respectively abutted against the bottom surface of the circuit board.

9. The electrical plug connector according to claim 4, wherein the metallic shell further comprises an enclosing shell, the enclosing shell comprises a body portion and two positioning plates extended outward from the body portion, the body portion encloses the tongue portion, the positioning plates are engaged with the base portion.

10. The electrical plug connector according to claim 9, wherein the circuit board comprises a plurality of terminal contacts and a ground contact, the other ends of the conductive terminals are respectively connected to the terminal contacts, the enclosing shell comprises a ground leg extended from one of the positioning plates and connected to the ground contact.

11. An electrical plug connector, comprising:

an insulated housing comprising a base portion, a tongue portion, and a plurality of recessed portions, wherein the tongue portion is extended forward from the base portion in the rear-to-front direction, the recessed portions are respectively configured at two sides of the base portion;

a plurality of conductive terminals respectively held at the base portion and the tongue portion, one of two ends of each of the conductive terminals located in the tongue portion, and the other end of each of the conductive terminals extended out of the base portion; and a metallic shell partially enclosing the insulated housing, wherein the metallic shell comprises:

a body shell partially enclosing the base portion, wherein two engaging grooves are respectively defined through two sides of the body shell;

two stopping pieces respectively protruded out of two lateral inner surfaces of the body shell to engage with the recessed portions;

two holding portions respectively configured at the two sides of the body shell and near to the engaging grooves, each of the holding portions comprises a bent sheet and an inward depressed portion, the bent sheet is connected between a portion of the body shell near to one of two opposite inner walls of the engaging groove and a portion of the body shell near to the other inner wall of the engaging groove, and the inward depressed portion is formed as an inner surface of the bent sheet; and an extending sheet extended outward from the rear of the body shell, wherein a plurality of engaging pieces are extended from two sides of the extending sheet and bent toward each other.

12. The electrical plug connector of claim 11, further including:

an inserting groove at the surface of the tongue portion, the one of two ends of the conductive terminals held at the tongue portion located in the inserting groove.

* * * * *